US007004686B2

(12) United States Patent
Mocivnik et al.

(10) Patent No.: US 7,004,686 B2
(45) Date of Patent: Feb. 28, 2006

(54) ROCK BOLTS WITH EXPANDABLE ELEMENT

(75) Inventors: Josef Mocivnik, Fohnsdorf (AT); Karl Bohm, Holzhausen (AT)

(73) Assignees: Techmo Entwicklungs- und Vertriebs GmbH, Fohnsdorf (AT); Alwag Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 10/885,734

(22) Filed: Jul. 8, 2004

(65) Prior Publication Data

US 2004/0231890 A1 Nov. 25, 2004

Related U.S. Application Data

(63) Continuation of application No. PCT/AT03/00019, filed on Jan. 21, 2003.

(30) Foreign Application Priority Data

Jan. 22, 2002 (AT) ..... A 97/2002

(51) Int. Cl.
*E21D 20/00* (2006.01)

(52) U.S. Cl. ..... 405/259.3; 405/289; 175/417

(58) Field of Classification Search ..... 405/289, 405/259.3, 244, 238, 249, 232; 175/417, 175/22

See application file for complete search history.

(56) References Cited

U.S. PATENT DOCUMENTS

| | | | | |
|---|---|---|---|---|
| 3,270,469 | A * | 9/1966 | Debiton | 52/2.26 |
| 3,349,567 | A * | 10/1967 | Munn | 405/259.3 |
| RE30,929 | E * | 5/1982 | Maimets | 405/150.1 |
| 5,184,919 | A * | 2/1993 | Smet | 405/184.3 |

FOREIGN PATENT DOCUMENTS

| | | |
|---|---|---|
| DE | 3111673 | 5/1982 |
| DE | 4024869 | 2/1991 |
| EP | 0047727 | 3/1982 |
| EP | 0077762 | 4/1983 |
| EP | 0079875 | 5/1983 |
| EP | 0016742 | 6/1984 |
| EP | 0112316 | 6/1984 |
| EP | 0207030 | 12/1986 |
| JP | 59024030 A * | 2/1984 |
| WO | WO91/06713 | 5/1991 |
| WO | WO97/31177 | 8/1997 |
| WO | WO98/21439 | 5/1998 |
| WO | WO98/58132 | 12/1998 |
| WO | WO00/75489 | 12/2000 |

* cited by examiner

*Primary Examiner*—David Bagnell
*Assistant Examiner*—Daniel P. Stephenson
(74) *Attorney, Agent, or Firm*—Jacobson Holman PLLC

(57) ABSTRACT

In a method and device for drilling, in particular impact drilling or rotary percussion drilling, a hole in soil or rock material and forming an anchorage in the hole, wherein a bore hole is formed by the introduction of a drill bit, it is provided that the drill rod assembly of the drilling device includes at least one expandable element having at least one hollow space extending substantially in the longitudinal direction of the bore for introducing a fluid under pressure to at least partially widen the outer periphery of the expandable element, and/or the drill rod assembly is connected with at least one expandable element each including at least one hollow space substantially extending in the longitudinal direction of the bore for introducing a fluid under pressure to widen the outer periphery, thus ensuring a safe anchorage by the expansion of the expandable elements both over the periphery and over the length of the device at a simplified overall construction.

14 Claims, 4 Drawing Sheets

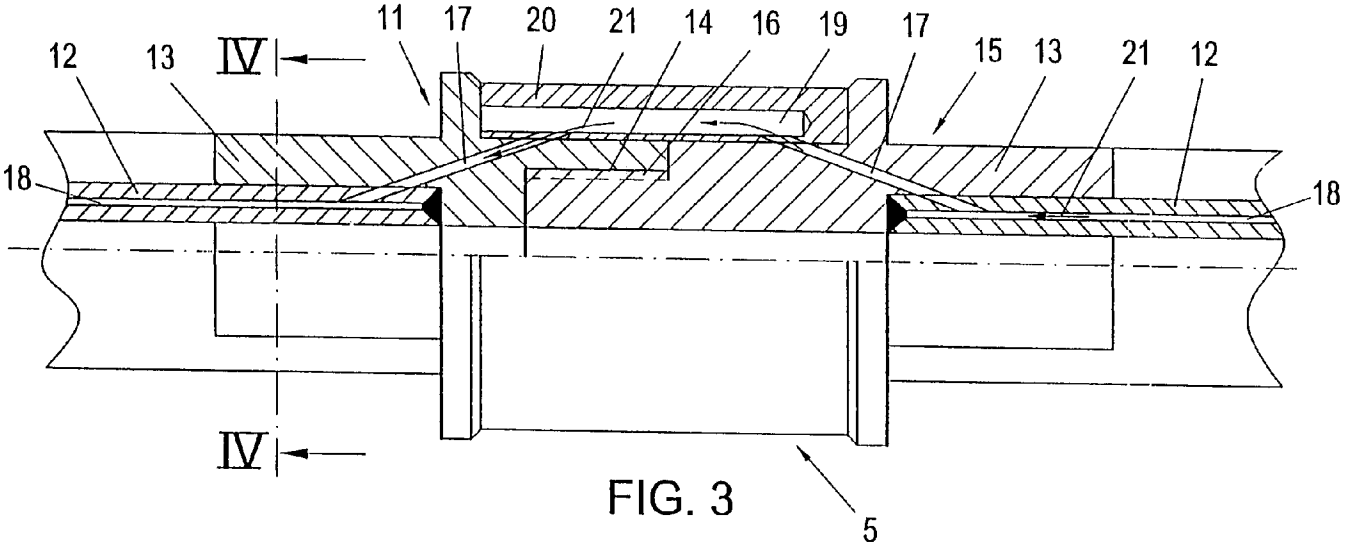
FIG. 3
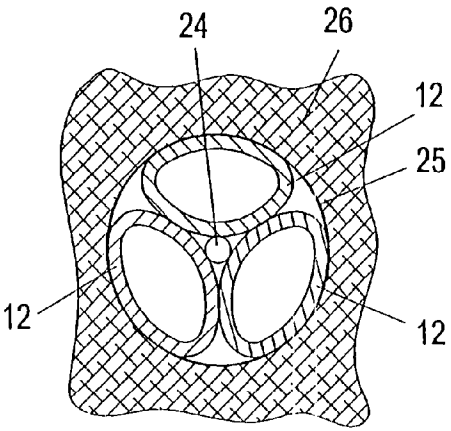
FIG. 4
FIG. 4c
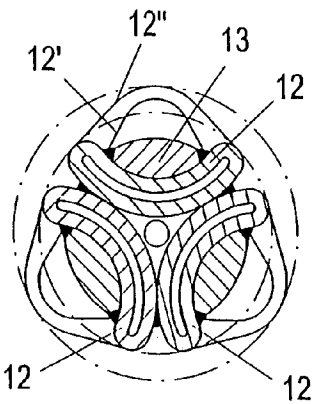
FIG. 4b
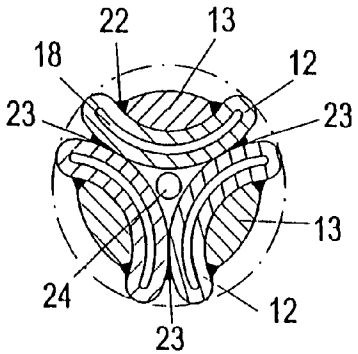
FIG. 4a

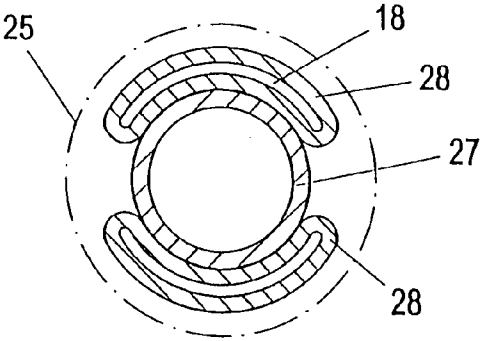
FIG. 5a
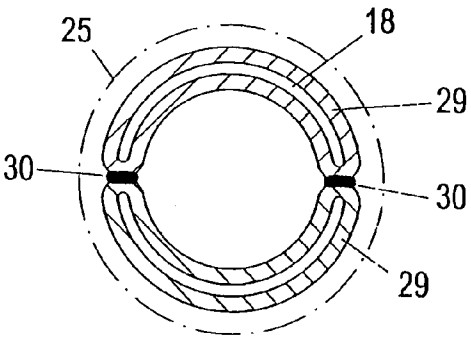
FIG. 5b
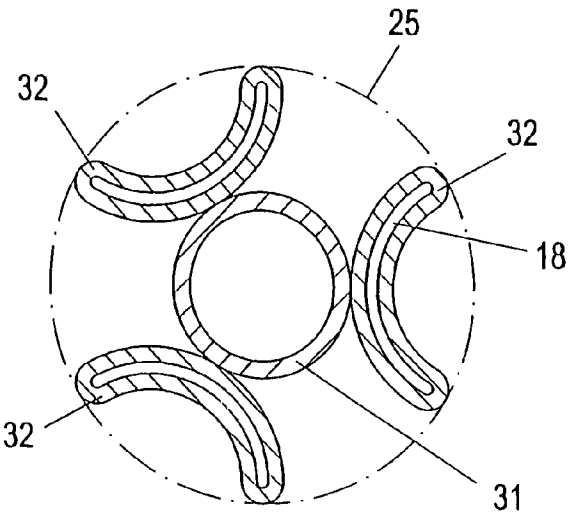
FIG. 5c
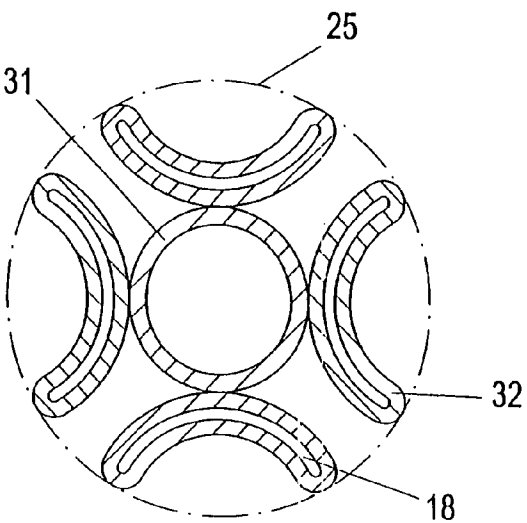
FIG. 5d
FIG. 5

ROCK BOLTS WITH EXPANDABLE ELEMENT

This is a continuation of PCT/AT03/00019 filed Jan. 21, 2003 and published in German.

FIELD OF THE INVENTION

The present invention relates to a method for drilling, in particular impact drilling or rotary percussion drilling, a hole in soil or rock material and forming an anchorage in said hole, wherein a bore hole is formed by the introduction of a drill bit, wherein, upon completion of the bore hole, a fluid under pressure is introduced into at least one hollow space extending substantially in the longitudinal direction of the bore, of at least one expandable element of the drill rod assembly, or into at least one hollow space of at least one expandable element connected with the drill rod assembly, to at least partially widen the outer periphery of said expandable element(s) powered with the fluid, in abutment on the bore hole wall. The invention further relates to a device for drilling, in particular impact drilling or rotary percussion drilling, a hole in soil or rock material and forming an anchorage, wherein a bore hole is formed by the introduction of a drill bit, wherein the drill rod assembly of the drilling device is comprised of at least one expandable element having a hollow space extending substantially in the longitudinal direction of the bore and provided for the introduction of a fluid under pressure to at least partially widen the outer periphery of said expandable element, and/or the drill rod assembly is connected with at least one expandable element each including a hollow space extending substantially in the longitudinal direction of the bore and provided for the introduction of a fluid under pressure to widen said outer periphery.

DESCRIPTION OF THE PRIOR ART

In the context of the production of a hole or bore hole in soil or rock material and the subsequent formation or fixation of an anchorage or lining in the bore hole, it is known, for instance, from WO 98/21439 and WO 98/58132 to introduce a jacket tube into the bore hole during the drilling procedure, for instance impact drilling or rotary percussion drilling, whereupon, after completion of the bore, part of the drill bit is optionally removed from the bore hole together with the drill rod assembly, while the jacket tube remains within the bore hole such that an anchor will subsequently be formed within the bore hole by filling a curing mass into the same. According to the configuration set out in WO 98/58132, the drill rod assembly may be provided with additional ribs and grooves on its outer periphery so as to ensure an accordingly good anchoring effect in case the drill rod assembly remains within the bore hole, which is subsequently filled.

A method and a device of the type mentioned above can be taken from WO 91/06713 or DE-A 40 24 869, for example, aiming at performing special drilling and injecting operations.

Alternatively, it is known to remove the drilling tool together with the drill rod assembly from a bore hole after the production of the bore hole, whereupon an anchor or anchoring means is subsequently introduced into the bore hole, it being referred, for instance, to EP-A 0 079 875, EP-B 0 047 727, EP-B 0 207 030, EP-B 0 016 742, EP-A 0 077 762, WO 97/31177, EP-A 0 112 316, WO 91/06713, DE-A 40 24 869, WO 00/75489, DE-A 31 11 673 or U.S. Pat. No. 4,636,115. In that known prior art, after the completion of a bore hole and subsequent removal of the drilling device, expandable anchoring elements are introduced into the bore hole, which are held at a reduced diameter relative to the bore hole during their introduction into the bore hole, whereupon, after the complete introduction into the bore hole, expandable partial regions of the anchoring device, which are folded during the introduction or generally reduced in terms of cross section, are expanded. That known prior art, in particular, involves the drawback that the folded regions do not readily enable the uniform expansion of the anchoring device and hence the centered positioning of the anchoring device, particularly where a plurality of adjacently arranged anchoring elements are provided. That known prior art, furthermore, involves the disadvantage that a bore hole has to be made in a first method step, whereupon, after the removal of the drilling tool plus drill rod assembly, the anchoring device is introduced into the optionally very long bore hole in a further method step, after which an abutment on the bore hole wall is to be enabled by widening the outer diameter of the anchoring device. It is immediately apparent that the two separate operating steps not only require accordingly more time, but that the subsequent introduction of such an anchoring device having a great length may entail problems. Furthermore, it is to be anticipated that the removal of the drilling device together with the drill rod assembly and the subsequent introduction of an anchoring device is feasible only in comparatively solid soil or rock, where it must be safeguarded that no material will break into the bore hole, for instance, during the drilling procedure or after the removal of the drilling tool and prior to the final introduction of the anchoring device, which would cause a blockage of the bore hole, thus impeding the introduction of the anchoring device.

Moreover, it is, for instance, known to arrange socalled packers about the outer periphery of the drill rod assembly of a drilling device, which upon completion of the bore enable an expansion into abutment on the bore hole wall over a short partial region, thus opposing the extraction or removal of the drill rod assembly from the bore hole. It is, however, not feasible by means of such packers to obtain a reliable anchoring effect aimed to stabilize the surrounding soil or rock material, particularly where a plurality of anchors to be adjacently arranged are provided, so that additional anchoring means such as, for instance, the application of a curing material will optionally have to be provided.

SUMMARY OF THE INVENTION

Departing from the prior art mentioned in the beginning, the present invention aims to provide a method as well as a device of the initially defined kind, which enable the formation of an anchorage upon completion of a bore hole, particularly with a view to stabilizing the surrounding soil or rock material, at a simplified overall construction and, in particular, reduced time expenditures.

To solve these objects, a method of the initially defined kind is essentially characterized in that a plurality of mutually separated expandable elements having hollow spaces are provided about the periphery and/or length of the bore hole to be produced, to widen said outer periphery. Due to the fact that at least one element expandable by the introduction of a fluid is placeable in abutment on the bore hole wall after completion of the bore hole, it is ensured that in a single operation step immediately upon completion of the bore and, in particular, without removal of the drilling device from the bore hole, an anchorage and stabilization of the surrounding soil or rock material are feasible, whereby the expandable element may have an accordingly large length, thus providing a reliable anchorage. At least one expandable element is, thus, introduced along with the drill rod assembly immediately upon formation of the bore hole, or the drill rod assembly is formed by an at least partially expandable element, such that a proper anchorage will be obtained after completion of the bore hole at a simplified overall construction. In order to provide said anchorage, at least the outer periphery or outer contour of the at least one expandable element is at least partially expanded or enlarged so as to enter into abutment on the wall of the bore hole. By providing a plurality of expandable elements about the periphery of the bore hole to be produced and/or its length according to the invention, a uniform introduction of force both about the periphery and over the length of the bore hole, and hence an accordingly safe anchorage, will be achieved. It will be feasible, particularly when providing a plurality of expandable elements about the periphery of the bore hole, to maintain the centered arrangement of the drilling device in the completed bore hole while simultaneously expanding the expandable elements, and hence to even out the force introduction into surrounding soil or rock material.

In order to properly fix the expandable elements to one another or to a central drill rod assembly, respectively, as well as secure the proper expansion of the expandable elements, it is, moreover, provided in a preferred manner that a plurality of expandable elements each having a hollow space are fixed, particularly welded each over a portion of their lengths, to one another or to a central drill rod assembly, respectively. Since the expandable elements must be made accordingly resistant and, in particular, of a metallic material, especially where they directly constitute the drill rod assembly, it is apparent that accordingly large forces must be introduced to expand the expandable elements so as to ensure the proper fixation of the elements to one another and/or the drill rod assembly.

In order to extend the drilling device so as to enable the formation of bore holes having great lengths, it is known to respectively connect appropriate rod assembly elements, wherein it is preferably proposed in connection with the present invention that the drill rod assembly comprising the expandable elements, and/or the expandable elements forming the drill rod assembly, are extended via connection elements through which the fluid for expanding the expansion elements is conducted, such connection elements safeguarding that the fluid to be introduced into the expandable elements after completion of the bore will be safely introduced into the plurality of expandable elements.

As pointed out above, accordingly resistant expandable elements are to be provided, in particular, if the expandable elements directly constitute parts of the drill rod assembly, wherein, in order to ensure the proper expansion of the elements in abutment on the surrounding soil or rock material upon completion of the bore, fluid under high pressure is to be introduced, it being contemplated according to another preferred embodiment that the fluid is introduced into the interior or hollow spaces of the expandable elements at a pressure of at least 100 bar and, in particular, at least 150 bar.

In addition to the introduction of a fluid under pressure for expanding the elements upon completion of the bore so as to form an anchorage, it is generally known, during a drilling operation, to introduce into the region of the drill bit a fluid for flushing and/or cooling the drill bit and optionally also hauling excavated material, it being proposed in the context of the present invention that a fluid for cooling and/or flushing the drill bit is introduced into the region of the drill bit via the drill rod assembly or a duct during the drilling operation, as in correspondence with a further preferred embodiment of the method according to the invention.

To solve the objects set out in the beginning, a device of the initially defined kind, moreover, is essentially characterized in that a plurality of mutually separated expandable elements having hollow spaces are provided about the periphery and/or length of the bore hole to be produced, to widen said outer periphery. As already pointed out above, it is feasible to ensure a safe and reliable anchorage within the bore hole by providing a plurality of expandable elements upon completion of the bore while introducing a fluid under pressure into said expandable elements, whereby the subsequent insertion of an anchor may be obviated. When providing expandable elements that extend over an accordingly large partial region of the length of the bore, it is moreover feasible to obtain a safe anchorage and stabilization of the surrounding soil or rock material.

In order to even out the anchoring effect and to safeguard the anchorage over a large length, it is provided according to a further preferred embodiment that a plurality of expandable elements for the formation of the drill rod assembly are connected with one another at least over a portion of their lengths and, in particular, welded with one another in contiguous rim regions. The fixation of several expandable elements to one another, or to a drill rod assembly, at least over partial regions of their lengths enables the safe introduction of the drilling device, wherein accordingly large forces have to be transmitted to introduce the drilling energy, what calls for a reliable connection of the individual elements to one another.

According to another preferred embodiment, it is proposed that a plurality of expandable elements are fixed, particularly welded over a length portion, to a central drill rod assembly, whereby the safe fixation of the expandable elements to the drill rod assembly will be achieved during the drilling procedure. By providing a plurality of expandable elements, it is moreover ensured during the subsequent anchorage and expansion that the drill rod assembly will remain in its mid or central position, thus providing a reliable anchorage effect.

As already indicated above, it is known, particularly when forming bore holes of great lengths, to extend respective rod assembly parts of the drilling device, wherein it is preferably proposed according to the present invention, with a view to introducing the fluid intended for the expansion of the expandable elements upon completion of the bore, that the drill rod assembly and the expandable elements, or the expandable elements forming the drill rod assembly, are extendable by connection elements comprising passages for conducting therethrough the fluid intended to widen the expandable elements.

In order to safely fix the expandable elements to the connection elements, it is proposed according to a further preferred embodiment that the connection elements partially overlap the consecutively arranged expandable elements, particularly by projections, and are connected, particularly welded, with the expandable elements. Such connection element regions or projections partially overlapping the expandable elements serve to properly fix the expandable elements to the connection element and/or to one another.

As already indicated above, a plurality of expandable elements are provided for the formation of a uniform or central anchorage about the periphery of the bore to be produced, wherein it is proposed in this context, according to a further preferred embodiment, that, in the peripheral direction, at least three expandable elements are provided for the formation of the drill rod assembly or are connected with a central drill rod assembly, respectively. When providing at least three expandable elements, it is not only feasible to properly and reliably introduce the forces to be transmitted onto the drill bit for the formation of the bore, but it is also safeguarded during the expansion process that an accordingly central positioning of the anchor, and hence a uniform stabilization of the surrounding soil or rock material, will be achieved.

In order to obtain a reliable expansion, and hence abutment on the wall of the bore hole, even with accordingly resistant materials constituting the expandable elements, it is contemplated according to another preferred embodiment that the expandable elements are sickle-shaped in a cross section normal to their longitudinal direction. Such sickle-shaped tubular elements can be produced by simple tools with the appropriate contour and strength and, in the following, will enable the simple fixation to one another or to a central drill rod assembly, respectively, thus ensuring a favorable adaptation to the subsequent expansion at an accordingly reduced application of the force to be introduced by the fluid.

According to another preferred embodiment, it is proposed that the expandable elements are connected with one another, or fixed to a central drill rod assembly, by partial regions extending substantially radially outwards or projecting radially outwards, it being is contemplated in this context, according to a particularly preferred embodiment, that the expandable elements exhibit or define a star-shaped contour in a plane extending normal to the longitudinal direction of the bore hole. Such a configuration allows for the reliable introduction of the forces required for the production of the bore, whereby proper centering within the bore hole is feasible already during the drilling operation on account of the stellate contour, while the central or mid position can likewise be maintained by said expansion.

In order to enable the flushing and/or cooling of the drill bit and optionally also the haulage of excavated material, it is proposed according to a further preferred embodiment that a fluid for cooling and/or flushing the drill bit is capable of being introduced into the region of the drill bit through the drill rod assembly or a duct during the drilling operation.

In order to ensure the proper fixation of the drill bit to the element forming the drill rod assembly, it is, moreover, provided in a preferred manner that the drill bit is fixed to the drill rod assembly or the expandable elements forming the drill rod assembly, respectively, by welding, screwing or the like.

SHORT DESCRIPTION OF THE DRAWINGS

In the following, the invention will be explained in more detail by way of exemplary embodiments schematically illustrated in the accompanying drawing. Therein:

FIG. 3 is a partially sectioned side view on an enlarged scale, of a connection element used to extend a drill rod assembly as well as the expandable elements of a device according to the invention;

FIG. 4 depicts sectional views of the embodiment according to FIG. 3, FIG. 4*a* being a section along line IV—IV of FIG. 3, FIG. 4*b* being a section similar to that of FIG. 4*a* with additional contour lines illustrating a partial expansion of the expandable elements at a distance from the sectional line IV—IV of FIG. 3, and FIG. 4*c* being a section through the expandable elements after completion of the expansion process; and FIG. 5 depicts different embodiments of the arrangement of expandable elements of devices according to the invention in illustrations similar to that of FIG. 4*a*.

DETAILED DESCRIPTION OF PREFERRED EMBODIMENTS

Figure 1:
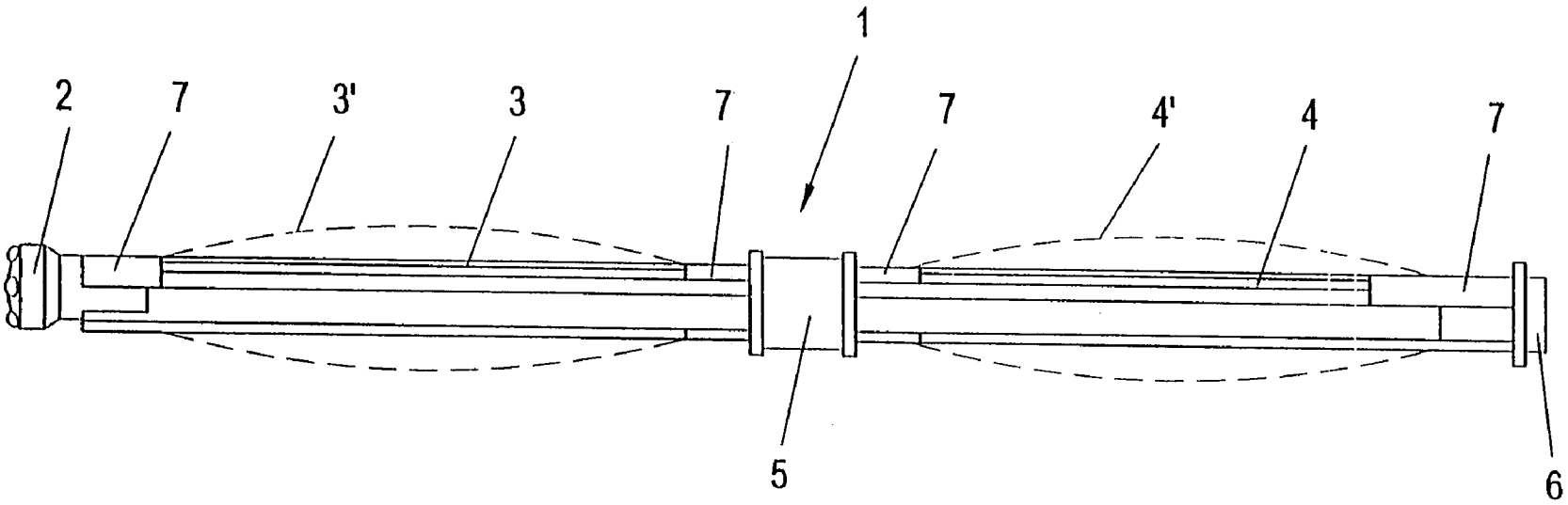
FIG. 1 is a schematic side view of a first embodiment of a device according to the invention for carrying out the method of the invention.

In the schematic representation according to FIG. 1, a drilling device is generally denoted by 1, wherein a drill bit schematically indicated at 2 is fixed to a drill rod assembly comprised of several individual parts 3 and 4, said individual rod assembly parts 3 and 4 being connected or extended by a connection element schematically indicated by 5, a detailed configuration being more clearly visible in FIG. 3.

As is apparent from the following representations, the rod assembly parts 3 and 4 are comprised of a plurality of expandable elements, or a plurality of expandable elements are provided around a central drill rod assembly, wherein a means not illustrated in detail engages at an end denoted by 6 to introduce the drilling and impact energy into the drill bit 2.

As is schematically indicated in FIG. 1, the expansion of expandable elements into the positions indicated by broken lines 3' and 4' is effected upon completion of the bore hole about the periphery and also over the length of the drilling device 1 such that, by expanding at least the outer periphery or outer contour, both the stable anchorage of the drilling device 1 in the bore hole not illustrated in detail and the stabilization of surrounding soil or rock material will altogether be obtained.

FIG. 1, moreover, indicates that, both in the region of the connection element 5 and the terminal end 6 and in the region of the fixation of the rod assembly parts 3 and 4 to the drill bit 2, the fixation of the expandable elements or, in general, rod assembly parts 3 and 4, which are shown in detail in the following Figures, both to each other and to the connection element 5, the terminal element 6 as well as the drill bit 2 is each effected over a partial region 7 such that in those partial regions 7 a safe fixation will be realized, which is able to resist any expansion even during the introduction of a fluid under high pressure, for instance a pressure of at least 100 bar, into the interior of the expandable elements, and an overall barrel- or cushion-shaped outer contour 3', 4' will be obtained upon expansion for the formation of the anchorage.

Figure 2:
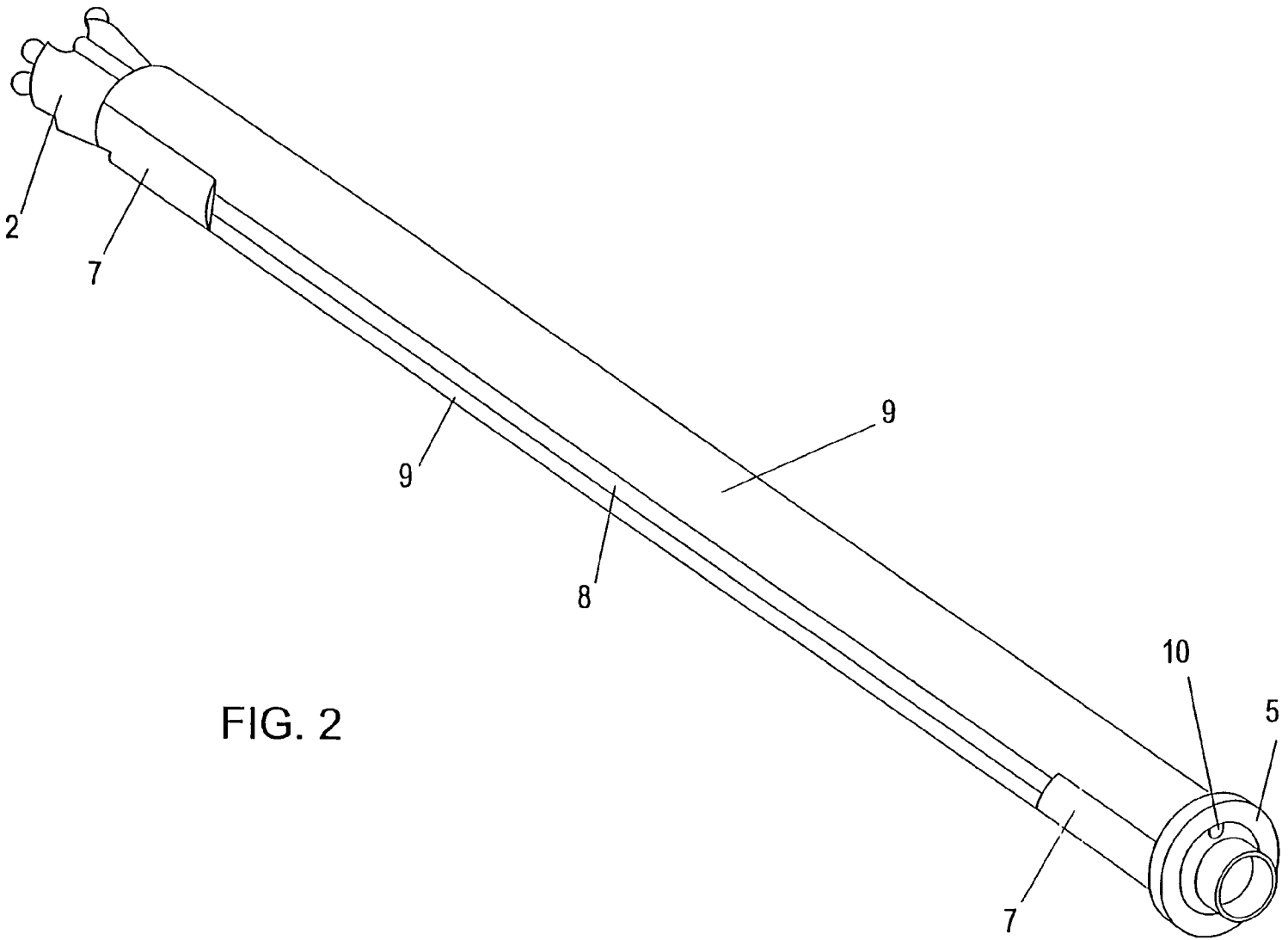
FIG. 2 is a side view of a modified embodiment of a device according to the invention in a perspective illustration.

From the illustration according to FIG. 2, it is apparent that substantially semicircular expandable elements 9 are provided on a central drill rod assembly 8, which is connected with the drill bit again denoted by 2, wherein the expandable elements 9 are fixed, for instance welded, with the drill rod assembly via partial regions again denoted by 7, in the region of the connection both to the drill bit 2 and a connection element again schematically indicated by 5. Within the connection element 5 according to FIG. 2, an entry opening is indicated at 10, which enables the introduction of fluid under pressure into the expandable element 9 as is more clearly apparent particularly from the illustration according of FIG. 3, so that an expansion of the expandable elements 9 for the formation of an anchorage will again be feasible upon completion of the bore.

As already indicated above, FIG. 3 depicts the region of a connection element 5 in detail. A first connection element 11 is fixed and, in particular, welded to a plurality of expandable elements 12 with projections 13 at least partially overlapping the expandable elements 12, as is also clearly apparent from the sectional representation according to FIG. 41*a*. The connection element 11 comprises an internal thread 14 into which a second connection element 15 can be screwed via a mating external thread 16, whereby also the second connection element 15 is designed to comprise appropriate projections 13 in order to again overlap expandable elements 12 at least partially.

In the end regions of the expandable elements 12 as well as in the connection elements 11 and 15, respectively, are provided passages or passage channels 17 which run into the hollow spaces 18 of the expandable elements 12. In addition, these passages run into a connection channel or passage 19 formed within a bushing- or sleeve-shaped element 20 surrounding or encompassing the region of connection of the connection elements 11 and 15.

As is indicated by arrows 21, the introduction of a fluid under pressure into all of the hollow spaces 18 of the adjoining expandable elements 12 is feasible via passages 17 and 19 so as to cause the expansion of the expandable elements 12 upon completion of a bore by the introduction of said fluid under pressure, for instance under a pressure of at least 100 or 150 bar.

As is apparent from the illustrations according to FIG. 4, no central drill rod assembly is provided in this embodiment, the drill rod assembly being comprised of three expandable elements 12 each designed in a sickle-like manner, wherein the expandable elements are connected and, in particular, welded with the overlapping partial regions 13 in the region of the connection elements 11 and 15, respectively, as is each indicated by 22 in FIGS. 4*a* and 4*b*. Moreover, also the expandable elements 12 are connected with one another at least over partial regions of their lengths via additional welding points 23.

In FIG. 4, it is, furthermore, indicated that an additional duct 24 intended to introduce a fluid into the drill bit for cooling or flushing of the same is provided in the free space left between the elements 12.

In the illustration according to FIG. 4*b*, it is schematically indicated how an expansion, upon introduction of a fluid under pressure, into the positions denoted by 12' and 12", respectively, is feasible in partial regions at distances from the connection elements 11 and 15, respectively, and, in particular, at distances from the projections 13 partially overlapping the expandable elements 12.

From the illustration according to FIG. 4*c*, it is apparent how the expanded elements 12 will abut on the bore hole wall 25 after completion of the expansion procedure in partial regions at larger distances from the connection elements 11 and 15, respectively, with an accordingly central or mid positioning becoming feasible by providing three expandable elements 12 about the periphery of the bore hole, thus also enabling an accordingly uniform introduction of forces into the surrounding soil or rock material 26 as well as a uniform stabilization of the same.

The schematic illustrations according to FIG. 5 depict further modified embodiments, the configuration according to FIG. 5*a* comprising two expandable elements 28 each provided on a central drill rod assembly 27. Again, substantially sickle-shaped expandable elements 28 are employed, which, upon completion of the bore, enable the expansion and accordingly reliable abutment on the bore hole wall again denoted by 25, and hence a reliable anchorage, by the introduction of fluid under pressure. By providing two expandable elements 28 in a peripherally distributed manner, it is safeguarded upon expansion that the drill rod assembly 27 will keep its central position such that, particularly when providing a plurality of adjacently located bore holes 25, an accordingly uniform anchorage and stabilization of the surrounding soil or rock material will be safeguarded over the respective surfaces.

Both in the embodiment according to FIG. 5*a* and in the other embodiments schematically illustrated in FIG. 5, it is provided as in the preceding embodiments that expandable elements are connected, particularly welded, with one another, or with a central drill rod assembly, over at least partial regions of their lengths and that an expansion each over a partial length region results in a barrel- or cushion-shaped outer contour, as is schematically indicated in FIG. 1. An extension aimed to achieve large drilling lengths is again effected by means of appropriate connection elements, as is schematically illustrated, for instance, in FIG. 3.

In the configuration according to FIG. 5*b*, again two expandable elements 29 are employed, wherein, as in contrast to the embodiment according to FIG. 5*a*, no central drill rod assembly is, however, provided such that the expandable elements 29, which are connected with one another over at least partial regions by a welding site each indicated at 30 will also assume the function of the drill rod assembly with a view to introducing the drilling or impact energy.

After completion of the bore, a fluid under pressure is again introduced into the hollow spaces 18 of the expandable elements 29 to cause the latter to abut on the bore hole wall 25 so as to provide an anchorage.

In the embodiment according to FIG. 5*c*, a central drill rod assembly 31 is again used, wherein three expandable elements 32 are provided in a peripherally distributed manner, which, in a manner similar to the embodiment according to FIG. 4*a*, are formed with outwardly protruding projections, thus again defining a substantially star-shaped external cross section. As is apparent from this illustration, the expandable elements cause the drill rod assembly 31 to be centered already during the drilling procedure by abutment on the bore hole wall 25, centering and abutment on the bore hole wall 25 being subsequently maintained and ensured upon completion of the bore and introduction of a fluid under pressure into the hollow spaces 18 of the expandable elements 32.

In a manner similar to the embodiment according to FIG. 5*c*, four expandable elements 32 each including an outwardly protruding terminal region are symmetrically arranged on the central drill rod assembly 31 in the embodiment according to FIG. 5*d*, whereby centering on the bore hole wall 25 is feasible during the drilling operation and an accordingly safe and centered anchorage is attainable after expansion.

In all of the embodiments according to FIG. 5, an additional duct for the introduction of a flushing or cooling fluid may be provided in the central region or center, or the central drill rod assembly 27, 31 may be directly used as a passage cross section for the introduction of a flushing or cooling fluid into the region of the drill bit.

What is claimed is:

1. A method for drilling a hole in soil or rock material and forming an anchorage in said hole, said method comprising the steps of forming a bore hole by the introduction of a drill bit, upon completion of the bore hole, introducing a fluid under pressure into at least one hollow space, extending substantially in a longitudinal direction of the bore hole, of at least one expandable element of a drill rod assembly, or into at least one hollow space of at least one expandable element connected with the drill rod assembly, to at least partially widen an outer periphery of said at least one expandable element powered with the fluid, in abutment with a bore hole wall, wherein a plurality of mutually separated expandable elements having hollow spaces are provided about at least one of a periphery and a length of the bore hole to be produced, to widen said outer periphery, and welding each of a plurality of expandable elements each having a hollow space over a portion of their lengths, to one another or to the drill rod assembly, respectively.

2. The method according to claim 1 wherein the fluid is introduced into the interior or hollow spaces of the expandable elements at a pressure of at least 100 bar.

3. The method according to claim 1 wherein a fluid for at least one of cooling and flushing the drill bit is introduced into a region of the drill bit via one of the drill rod assembly and a duct during the drilling operation.

4. A method for drilling a hole in soil or rock material and forming an anchorage in said hole, said method comprising the steps of forming a bore hole by the introduction of a drill bit, upon completion of the bore hole, introducing a fluid under pressure into at least one hollow space, extending substantially in a longitudinal direction of the bore hole, of at least one expandable element of a drill rod assembly, or into at least one hollow space of at least one expandable element connected with the drill rod assembly, to at least partially widen an outer periphery of said at least one expandable element powered with the fluid, in abutment with a bore hole wall, wherein a plurality of mutually separated expandable elements having hollow spaces are provided about at least one of a periphery and a length of the bore hole to be produced, to widen said outer periphery, and extending one of the drill rod assembly comprising the expandable elements and the expandable elements forming the drill rod assembly via connection elements through which the fluid for expanding the expansion elements is conducted.

5. A drilling device for drilling a hole in soil or rock material and forming an anchorage in said hole, wherein a bore hole is formed by introduction of a drill bit, the drilling device comprising at least one expandable element having a hollow space extending substantially in a longitudinal direction of the bore and provided for introduction of a fluid under pressure to at least partially widen an outer periphery of said expandable element, a plurality of said expandable elements having hollow spaces provided about at least one of a periphery and a length of the bore hole to be produced, to widen said outer periphery, and a plurality of said expandable elements being welded over a length portion to a central drill rod assembly.

6. The drilling device according to claim 5 wherein a plurality of said expandable elements are connected to one another at least over a portion of their lengths and welded with one another in contiguous rim regions.

7. The drilling device according to claim 5 wherein the expandable elements are sickle-shaped in a cross section normal to their longitudinal direction.

8. The drilling device according to claim 5 wherein the expandable elements are connected with one another, or fixed to a central drill rod assembly, by partial regions extending substantially radially outwards or projecting radially outwards.

9. The drilling device according to claim 8 wherein the expandable elements exhibit or define a star-shaped contour in a plane extending normal to the longitudinal direction of the bore hole.

10. The drilling device according to claim 5 wherein a fluid for at least one of cooling and flushing the drill bit is introduced into a region of the drill bit through one of a drill rod assembly and a duct during the drilling operation.

11. The drilling device according to claim 5 wherein the drill bit is fixed to one of a drill rod assembly and the expandable elements forming a drill rod assembly, respectively, by one of welding and screwing.

12. A drilling device for drilling a hole in soil or rock material and forming an anchorage in said hole, wherein a bore hole is formed by introduction of a drill bit, the drilling device comprising at least one expandable element having a hollow space extending substantially in a longitudinal direction of the bore and provided for introduction of a fluid under pressure to at least partially widen an outer periphery of said expandable element, a plurality of said expandable elements having hollow spaces provided about at least one of a periphery and a length of the bore hole to be produced, to widen said outer periphery, and the at least one expandable element being extendable by connection elements comprising passages for conducting therethrough the fluid intended to widen the expandable elements.

13. The drilling device according to claim 12 wherein the connection elements partially overlap the consecutively arranged expandable elements by projections, and are connected, particularly welded, with the expandable elements.

14. A drilling device for drilling a hole in soil or rock material and forming an anchorage in said hole, wherein a bore hole is formed by introduction of a drill bit, the drilling device comprising at least one expandable element having a hollow space extending substantially in a longitudinal direction of the bore and provided for introduction of a fluid under pressure to at least partially widen an outer periphery of said expandable element, a plurality of said expandable elements having hollow spaces provided about at least one of a periphery and a length of the bore hole to be produced, to widen said outer periphery, and at least three said expandable elements being provided for formation of a drill rod assembly or connected with a central drill rod assembly, respectively.

* * * * *